US005161869A

United States Patent [19]

Albiez

[11] Patent Number: 5,161,869

[45] Date of Patent: Nov. 10, 1992

[54] DRAWER

[75] Inventor: Alfred Albiez, Langen, Austria

[73] Assignee: Alfit Aktiengesellschaft, Götzis, Austria

[21] Appl. No.: 710,509

[22] Filed: Jun. 4, 1991

[30] Foreign Application Priority Data

Jun. 11, 1990 [AT] Austria ..... 1264/90

[51] Int. Cl.[5] ..... A47B 88/00

[52] U.S. Cl. ..... 312/348.1; 403/380

[58] Field of Search ..... 312/348.1, 330.1, 348.2; 403/380, 375, 353

[56] References Cited

U.S. PATENT DOCUMENTS 4,842,351 6/1989 Rock et al. ..... 312/330.1 X
4,875,747 10/1989 Hollenstein ..... 312/330.1

FOREIGN PATENT DOCUMENTS 0322545 7/1989 European Pat. Off. .
2702217 7/1978 Fed. Rep. of Germany ... 312/348.1
3702238 8/1988 Fed. Rep. of Germany .
2169491 7/1986 United Kingdom .

*Primary Examiner*—Kenneth J. Dorner
*Assistant Examiner*—Brian K. Green
*Attorney, Agent, or Firm*—Collard & Roe

[57] ABSTRACT

The drawer comprises metal side walls, which define the drawer on its sides and are provided each at its bottom with an angled carrying flange for supporting a bottom plate of the drawer, wherein retaining elements which have been lanced from the carrying flanges extend into receiving recesses of the bottom plate. To permit a simple mounting of the bottom plate in the correct position and a simple machining of the bottom plate for the provision of retaining recesses in the bottom plate by a simple machining process, the retaining elements comprise two holding-down hooks, which serve to retain the bottom plate at one end face thereof and are provided in respective ones of the carrying flanges, the retaining recesses comprise a continuous groove, which extends in one end face of the bottom plate between the side edges thereof, and two inguiding surfaces are provided, which extend from the bottom surface of the bottom plate and as far as to the bottom side face of the groove and are adjoined by respective ones of the holding-down hooks, each of which is adapted to assume a final retaining position, in which a hook arm at the top of each hook extends from the inguiding surface into the groove.

8 Claims, 2 Drawing Sheets 1
2
3
4
5
6
7
8
9
10
11
12
13
14
15
17

DRAWER

BACKGROUND OF THE INVENTION

1. Field of the Invention

This invention relates to a drawer comprising two metal side walls laterally delimiting an interior of the drawer, each side wall having a laterally inwardly bent bottom flange extending in a longitudinal direction and having a plurality of stamped-out and upwardly bent retaining lugs spaced from each other in the longitudinal direction and extending substantially perpendicularly to the longitudinal direction, and a bottom plate having a bottom surface and extending between the side walls. The bottom surface of the bottom plate is supported on the bottom flanges, and the bottom plate has a front face, a rear end and lateral portions extending between the front face and the rear end adjacent the bottom flanges of the side walls.

The side walls of the drawers may have different heights and they preferably have means for guiding the drawer as it is extended. In particular they may be integrally formed with a guide rail for such guidance. If a rear wall is provided, it extends to the flanges of the side walls of the drawer and abuts the bottom plate. A front wall of the drawer is secured in most cases by separate, adjustable retaining means, independently of the means for fixing the bottom plate.

2. Description of the Prior Art

It is known that the bottom plate may be fixed by means of raised lugs stamped from the carrying flanges and press fit into bores of the bottom plate or into longitudinal grooves, which are formed in the bottom plate and are parallel to its edges. In accordance with British patent No. 2,169,491 the retaining lugs have been bent up around bend lines extending parallel to the longitudinal direction of the flange and extend into continuous grooves, which are formed in the bottom plate and extend parallel to its edges, and the height of the bent-up retaining lugs somewhat exceeds the depth of the groove, which has a small width, which substantially conforms to the thickness of the lugs, so that the pressing of the bottom plate onto the carrying flange will cause the retaining lugs partly to penetrate into the bottom of the groove. Such an arrangement will not ensure a satisfactory anchoring of the retaining lugs in the groove and a lifting of the bottom plate and its displacement along the groove will not adequately be prevented. From U.S. Pat. No. 4,875,747 it is known to provide the bottom plate with a somewhat wider groove and to bend up the retaining lugs about bend lines which include an acute angle with the longitudinal direction of the flange so that the lugs extend obliquely to the groove and their longitudinal edges will cut into the side faces of the groove as the bottom plate is forced onto the carrying flange. Also in that arrangement a lifting of the bottom plate from the carrying flanges will not adequately be prevented and the position to which the bottom plate is forced against the carrying flanges is not exactly defined so that the use of assembling machines must be expected to result in a fixation of the bottom plate with large longitudinal tolerances. In a different embodiment, claws, which can subsequently be bent, are used as retaining means and when they have been inserted into the bore or groove are bent to assume a final position, in which the claws have penetrated into the material which constitutes the side faces of the bore or groove. Such claws have previously constituted the optimum known means for preventing a displacement and lifting of the bottom plate but the mounting of such claws is time-consuming and can hardly be automated and even a subsequent manual bending of the claws will involve a higher risk of damage to the bottom plate and/or the claws. From German patent No. 37 02 238 it is known to provide at the rear end of a guide rail a hook for holding the rear end of a drawer box on its support.

SUMMARY OF THE INVENTION

It is an object of the invention to provide a drawer which is of the kind described first hereinbefore and in which an exact positioning of the bottom plate relative to the carrying flanges and a reliable fixation of the bottom plate in the correct position are ensured by the use of simple means permitting an automated assembling and/or requiring no or tools or require the use of only simple tools, and in which the bottom plate may be prepared automatically and while it is progressively advanced so that it can subsequently receive the retaining means.

According to the invention, the front face of the bottom plate defines a continuous groove extending between the lateral portions and the groove has a bottom face, each bottom flange has a holding-down hook adjacent the front face of the bottom plate, each hook having a hook arm extending into the groove in the longitudinal direction and engaging the bottom face thereof, and the bottom plate has two surfaces arranged adjacent the front face for guiding each hook into the groove, the guiding surfaces leading from the bottom surface to the bottom face of the continuous groove.

In addition to the holding-down hooks for fixing the bottom plate at one end face, other retaining means may be provided, which may be distributed over the length of the carrying flanges and may consist of bent-up lugs press fit into suitable receiving bores of the bottom plate, and the rear wall of the drawer may be used to hold down the bottom plate at its rear end. The groove and the bores for guiding the holding-down hooks may be formed in an automatic process, in which the bottom plate is progressively advanced. The groove itself may have various heights and depths and widths in dependence on the size of the drawer and of the material from which the bottom plate is made. Bottom plates may be made, inter alia, from wood, chipboard or composite board and may be coated on both sides. The groove which is formed in the end face and constitutes a part of the receiving recesses will either be provided at the rear end of the drawer or, in the preferred embodiment of the drawer, will be covered by the front plate of the drawer. The formation of the continuous groove and inguiding bores will not involve a risk of damage to the plate material.

In a preferred embodiment, the guiding bores are designed and arranged to permit the hooks arms of the holding-down hooks to be inserted into the groove when the bottom plate is held to be downwardly inclined toward the carrying flange and the bottom edge of the end face formed with the groove rests on the carrying flange so that the bottom plate can be swung down onto the carrying flange when the holding-down hooks have been inserted. Even while the bottom plate is thus swung down the bottom plate will be in a correct position relative to the carrying flanges so that further retaining means of the carrying flanges will reliably engage corresponding openings or recesses or bores of the bottom plate and after that additional fixation and/or after the mounting of means for holding down the plate at its other end, which means may consist of the rear wall of the drawer, the bottom plate will reliably be secured in the correct position.

The inguiding bores will hardly affect the strength of the bottom plate and will not undesirably damage the surface of coated bottom plates. As described hereinbefore the holding-down means may be hooked into position when the bottom plate is inclined or, if the further fixing means permit a longitudinal displacement of the bottom plate into engagement with the upstanding retaining member, the bores will preferably laterally open in the end face of the plate so that the bores have tapered edge portions and the distance from the geometric axis of the bore to the end face is smaller than the radius of the bore.

Alternatively, the inguiding bores are formed in the end face of the plate and extend from the bottom side face of the groove to the bottom surface of the plate.

In addition to, or instead of, such bores, the end face of the bottom plate may constitute below said groove a recessed surface, which is recessed from the remainder of said end face disposed above the groove, so that the upstanding portions of the holding-down hooks will adjoin said recessed surface when the hook arm of the hooks has entirely moved into the groove. A corresponding recessed surface or a chamfer which extends below the groove as far as to the bottom surface of the bottom plate will also facilitate the insertion of the hook arm of the holding-down hooks into the groove when the bottom plate is in an inclined position because owing to the provision of the chamfer or of the recessed surface the height of the groove over the flanges will not be larger in that inclined position than when the plate is horizontal.

The groove and the inguiding bores are preferably formed in the bottom plate in a process in which the bottom plate is progressively advanced and in which the bores are formed first and the continuous groove in the end face is formed immediately thereafter in the bottom plate. Receiving bores for upstanding retaining lugs may be drilled at the same time as the inguiding bores.

DETAILED DESCRIPTION OF THE PREFERRED EMBODIMENT

Figures 1, 2, 3:
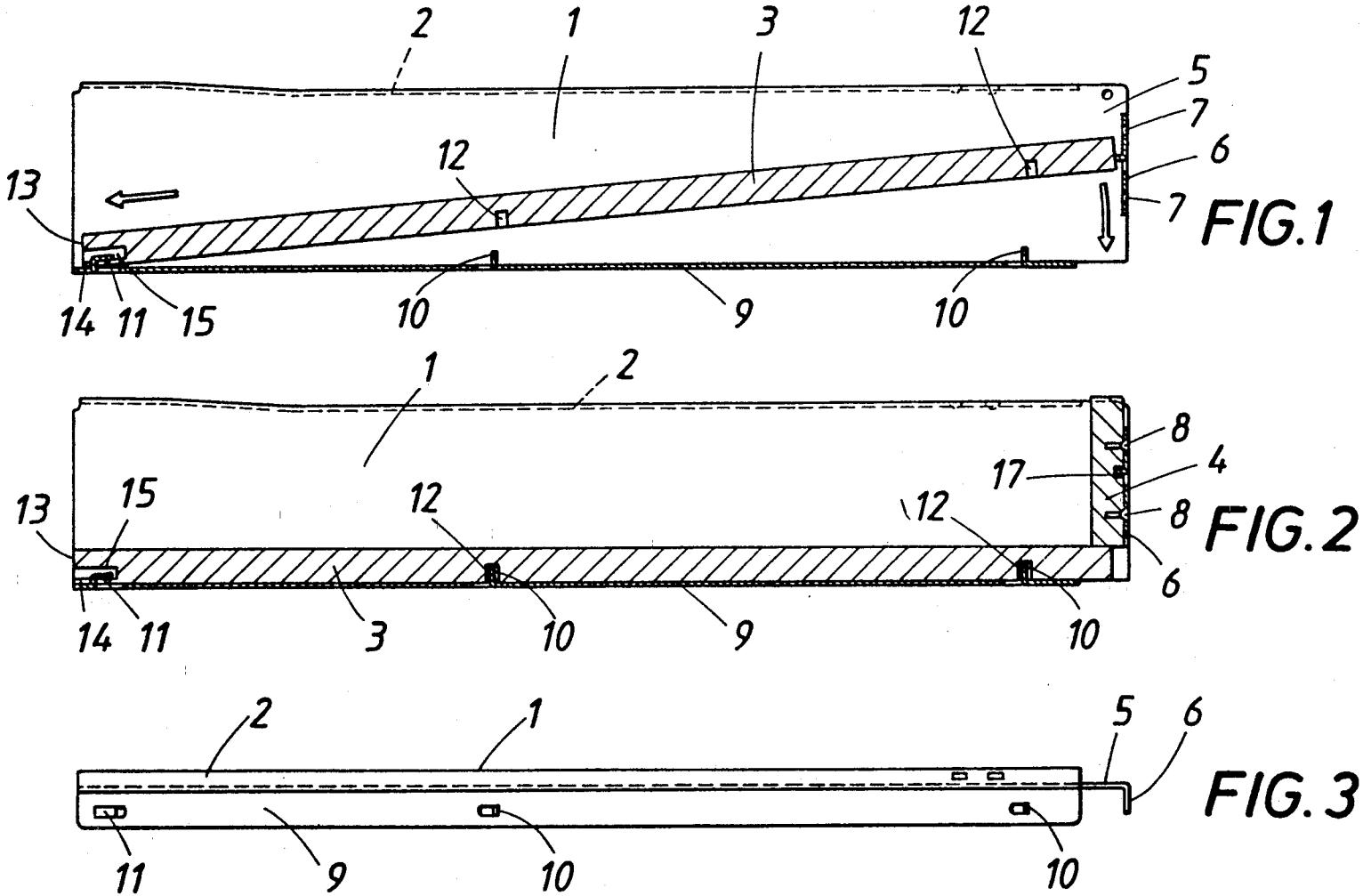
FIG. 1 is a side elevation showing a side wall of a drawer viewed from the inside and a longitudinal sectional view showing a bottom plate during the assembling operation.
FIG. 2 is a view that is similar to FIG. 1 and shows the bottom plate mounted in its final position and the rear wall of the drawer, also in section.
FIG. 3 is a top plan view showing the side wall.

Further details and advantages of the invention will become apparent from the following description of the drawings, in which the invention is illustrated by way of example.

The illustrated drawer comprises two metal side walls 1, each of which has a flange at the top to form a guide rail 2, which is a part of means for guiding the drawer as it is extended. The side walls 1 define the sides of the interior space of the drawer and that space is defined underneath by a bottom plate 3 and at the rear by a rear wall 4. A front plate, not shown, is normally mounted at the forward end and is adjustable. It covers the end face of the bottom plate 3 and may optionally be provided with a handle. The bottom plate 3 may consist of a board of wood, of chipboard or of a similar material and may be provided with a surface coating on one side or both sides. The web portion of the side wall 1 is provided in its intermediate portion with a longitudinal extension 5, whose end is bent over to form a retaining lug 6 formed with through openings 7 for screws 8 for fixing the rear wall of the drawer to the side walls.

Figure 4:
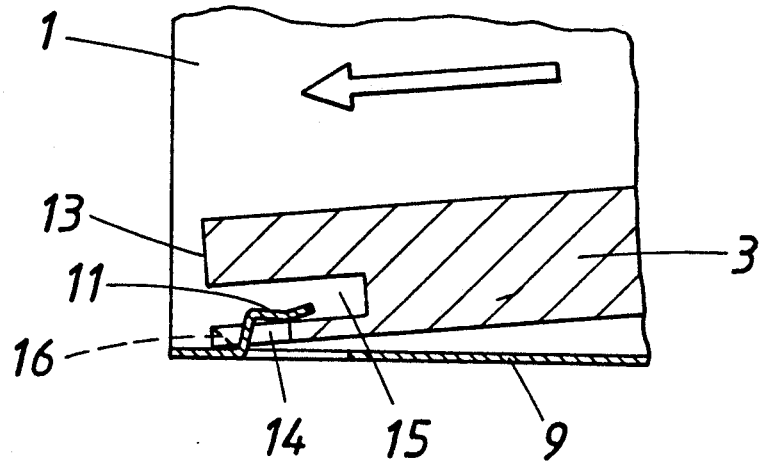
FIG. 4 is an enlarged view showing a detail of FIG. 1 adjacent to a holding-down hook.

Each side wall also has at its bottom a flange to form a carrying flange 9 for supporting the bottom plate 3 at one side edge thereof. Short retaining lugs 10 are stamped out of that carrying flange 9. Close to the forward end of the carrying flange 9, another lug is stamped out of the carrying flange 9 and like the lugs 10 has been bent up to extend transversely to the longitudinal direction of the flange. This lug has a top flange to form a hook 11. The free end of the hook may slightly be bent up to facilitate its insertion (see FIG. 4).

The bottom plate 3 is formed with openings 12 for receiving the retaining lugs 10. The openings 12 consist of bores whose diameter is slightly smaller than the width of the lugs 10 so that the lugs press fit on the bores.

Figure 5:
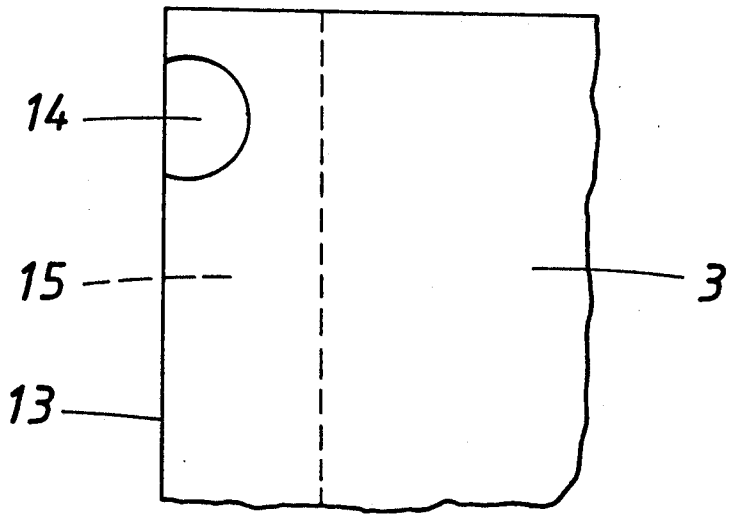
FIG. 5 is a bottom view showing the bottom plate of FIG. 4.

The end face 13 of the bottom plate is formed with a recess for receiving the holding-down hooks 11 provided on the two side walls. That recess consists of a groove 15, which extends throughout the length of the end face 13. Bottom plate 3 defines two bores 14 extending from the bottom surface and end face 13 of the plate 3 to the groove 15 (see FIG. 5). The bores 12 and 14 may be formed in the bottom plates 3 by means of multiple-spindle drilling machines and the groove 15 in the end face may subsequently be milled. That manufacture will permit the bottom plates 3 to be prepared in a simple process, which can be fully automated and in which the bottom plates are progressively advanced.

As is apparent from FIG. 1 the bottom plate 3 can be pushed onto the holding-down hooks 11 when the bottom plate is downwardly inclined toward its end face 13 relative to the flanges 9. Bores 14 will facilitate the insertion of the holding-down hooks 11 and will finally accommodate the upstanding portions of said hooks. To decrease the height of the forward edge of groove 15 adjacent to the bore 14, the end face of the plate 3 may comprise a chamfer 16 below the groove 15. When the holding-down hooks have entirely been inserted, they extend from the inner edge of the bore 14 into the groove and that inner edge of the bore 14 constitutes a stop. As the bottom plate 3 is swung down from the position shown in FIG. 1 or FIG. 4 to the position shown in FIG. 2, the retaining lugs 10 will enter the bores 12 as a press fit so that the bottom plate is held against displacements in the longitudinal and transverse directions in addition to the retaining action of the holding-down hooks and a lifting of the bottom plate adjacent to the end face 13 will be prevented by the holding-down hooks 11. When the rear wall 4 of the drawer has been mounted over the end portion with which the bottom plate 3 extends under the rear wall 4, the bottom plate will be fixed also at its rear end against a lifting from the flange 9 so that the bottom plate will then permanently be secured in its entirety in its correct position. The rear wall 4 of the drawer may also be formed with a bore 17 for receiving an adjusting lug, which has been bent up from the part 7.

What is claimed is:

1. A drawer comprising:

(a) two metal side walls laterally delimiting an interior of the drawer, each side wall having (1) a laterally inwardly bent bottom flange extending in a longitudinal direction and having a plurality of stamped-out and upwardly bent retaining lugs spaced from each other in the longitudinal direction and extending substantially perpendicular to the longitudinal direction, and (b) a bottom plate having a bottom surface and extending between the side walls, the bottom surface of the bottom plate being supported on the bottom flanges, and the bottom plate having a front face, a rear end and lateral portions extending between the front face and the rear end adjacent the bottom flanges of the side walls, (1) the front face of the bottom plate defining a continuous groove extending between the lateral portions and the groove having a bottom face, (2) each of the bottom flanges having a holding-down hook adjacent the front face of the bottom plate, each hook having a hook arm extending into the groove in the longitudinal direction and engaging the bottom face thereof, and (3) the bottom plate has two surfaces arranged adjacent the front face for guiding each of the hooks into the groove, the guiding surfaces leading from the bottom surface to the bottom face of the continuous groove.

2. The drawer set forth in claim 1, wherein said guiding surfaces are designed and arranged to permit said hooks to be guided by said guiding surfaces to said bottom face of said groove when said bottom plate is held to be downwardly inclined toward said front face relative to said bottom flanges, and said bottom plate is adapted to be swung down onto said bottom flanges when said hook arms extend in said groove.

3. The drawer set forth in claim 1 wherein said guiding surfaces define bores extending in said bottom plate from the bottom surface and open into said groove.

4. The drawer set forth in claim 3, wherein said bores are laterally open in said front face of said bottom plate.

5. The drawer set forth in claim 1, wherein said guiding surfaces define recesses extending in said front face of said bottom plate from said bottom surface to said bottom face of said groove.

6. The drawer set forth in claim 1, wherein said front face of said bottom plate has below said groove a chamfer adjoining said bottom surface of said bottom plate.

7. The drawer set forth in claim 1, wherein each guiding surface is recessed from the front face below said groove.

8. The drawer set forth in claim 7, wherein said recessed surface adjoins said bottom face of said groove.

* * * * *